US006592092B2

(12) United States Patent
Stahlberg

(10) Patent No.: US 6,592,092 B2
(45) Date of Patent: Jul. 15, 2003

(54) INVERTED CONTAINER SUPPORT CUBE

(76) Inventor: Luke Stahlberg, 15615 Country Ridge Dr., Chesterfield, MO (US) 63017

( * ) Notice: Subject to any disclaimer, the term of this patent is extended or adjusted under 35 U.S.C. 154(b) by 33 days.

(21) Appl. No.: 09/931,535

(22) Filed: Aug. 17, 2001

(65) Prior Publication Data

US 2003/0034427 A1 Feb. 20, 2003

(51) Int. Cl.[7] ..... A47K 1/08

(52) U.S. Cl. ..... 248/311.3; 248/108; 206/217; 211/74; 222/173

(58) Field of Search ..... 248/311.3, 312, 248/108, 109; 220/290; 222/173; 206/217; D21/499; 446/120, 125; 211/72, 74

(56) References Cited

U.S. PATENT DOCUMENTS 4,482,522 A * 11/1984 Baudisch et al. ..... 211/74
4,698,023 A * 10/1987 Marino ..... 446/125
4,938,369 A * 7/1990 Carilli ..... 211/74
5,000,713 A * 3/1991 Cheng ..... 446/120
5,071,002 A * 12/1991 Bradley ..... 206/217
5,205,525 A * 4/1993 Peck ..... 248/311.2
5,263,787 A * 11/1993 Wilcox et al. ..... 220/290
D343,767 S * 2/1994 Sambrookes et al. ..... D7/619
5,285,907 A * 2/1994 Franchere et al. ..... 211/74
5,460,298 A * 10/1995 DiBiase et al. ..... 222/173
5,560,406 A * 10/1996 Fineroff et al. ..... 248/311.3
5,664,753 A * 9/1997 Takei ..... 248/311.3
5,702,009 A * 12/1997 Ouellet et al. ..... 248/311.3
D437,366 S * 2/2001 Stemmler ..... D21/499
6,382,579 B1 * 5/2002 Kenniston ..... 248/311.3
D464,682 S * 10/2002 Lin ..... D21/499

* cited by examiner

*Primary Examiner*—Anita King

(57) ABSTRACT

The nature of the invention is to facilitate the complete use of substances that are packaged in containers with odd or irregular shaped tops that double as the dispenser for the substance in the container. As is the rule with gravity, when a container of glue, for example, with a small cone-shaped top/dispenser is placed in storage, the glue settles to the bottom of the container. In order to use as much of the glue as possible, and do so in a timely manner (the value of which increases as the container nears empty), it becomes necessary to either lean or prop the container against a solid object while waiting for the glue to settle on the inverted top prior to dispensing, an action not always desirable or feasible. The cube-shaped invention with varying openings in each side allows for storage in the inverted position of a variety of odd-shaped top/dispenser containers; thereby, permitting easy, rapid use of the substance within a container, especially as the container nears empty.

6 Claims, 2 Drawing Sheets

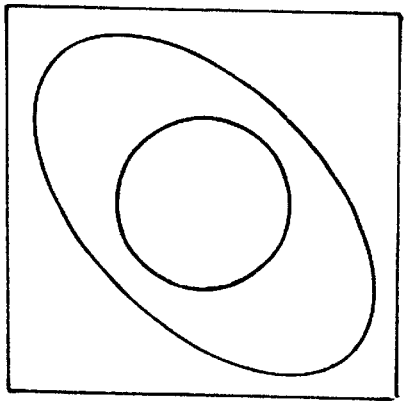
FIG. 2
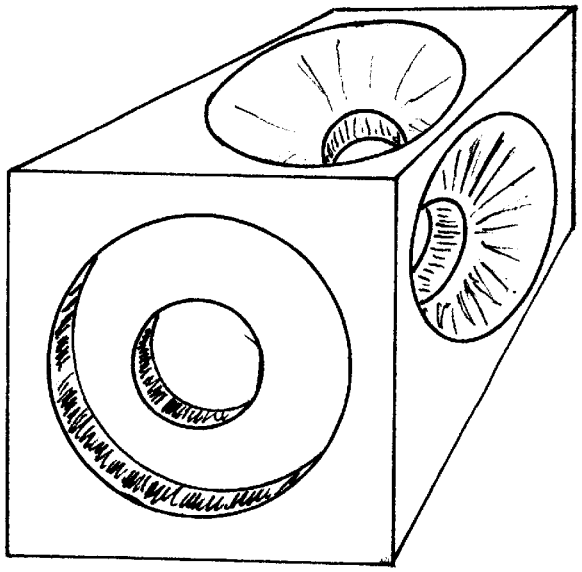
FIG. 7
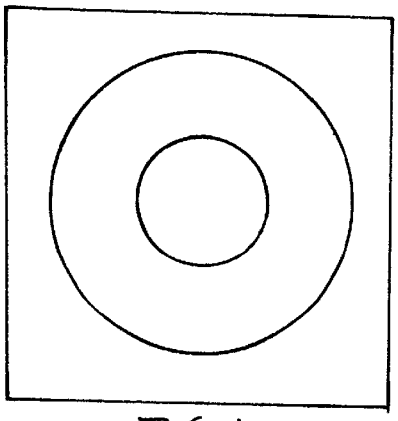
FIG. 1
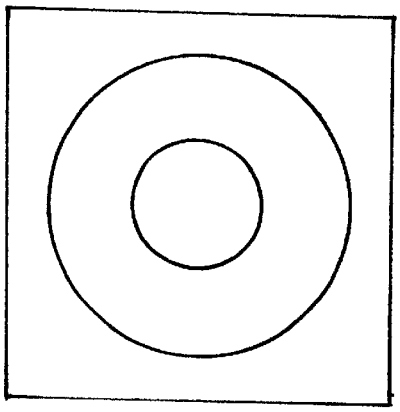
FIG. 3
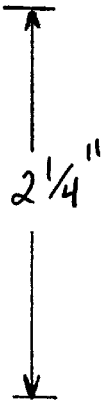

INVERTED CONTAINER SUPPORT CUBE

CROSS REFERENCE TO RELATED APPLICATIONS

Not Applicable

STATEMENT REGARDING FEDERALLY SPONSORED R & D

Not Applicable

REFERENCE TO A SEQUENCE LISTING, A TABLE, OR A COMPUTER PROGRAM LISTING APPENDIX

Not Applicable

BACKGROUND OF THE INVENTION

The field of endeavor to which this invention pertains can be categorized as 'general' with respect to the many and varied materials and foods contained in the many and variously shaped containers which may be supported by the invention.

In other words, this invention, for which a Utility patent application is being filed, can be used in most sectors of the human experience; including, but not limited to, the more thorough use of the containerized materials and foods that are used in the home to those used in industry.

In its simplest form the platform is a cube with a hollow core and variously shaped and sized holes in each side to be used to support an inverted container, which would be unable to stand alone while inverted, in order to use as much of the product within the container as gravity will allow. Examples of products that may be more thoroughly consumed by use of the invention are within the containers of a well known glue manufacturer or some honey containers.

BRIEF SUMMARY OF THE INVENTION

The general idea, and therefore the obvious advantage, of the invention is to enable an individual to invert a container with an odd-shaped top (which is also the dispensing area for the substance inside), such as some well known glue or honey containers, and leave it for long periods of time, so that when acted upon by gravity the substance within the container settles in the area used for dispensing the substance; thereby, allowing one to use most, if not all, of the substance for which he has paid.

BRIEF DESCRIPTION OF THE DRAWINGS

FIG. 1 Large cylinder, large hole—one and three-quarter inch diameter by one-quarter inch deep cylinder with three-quarter inch diameter, centered hole.

FIG. 2 Large oval, large hole—two inch by one and one-quarter inch oval beveled to a depth of approximately one-quarter of an inch at circumference of one inch diameter, centered hole.

FIG. 3 Large cone, large hole—one and three-quarter inch diameter cone beveled to a depth of approximately three-eighths of an inch at circumference of three-quarter inch diameter, centered hole.

FIG. 7 Perspective view with FIG. 1 in front, FIG. 2 on top, and FIG. 3 on right.

DETAILED DESCRIPTION OF THE INVENTION

Figure 5:
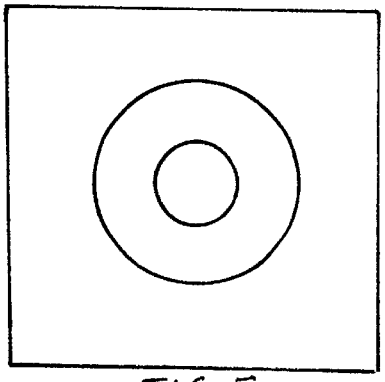
FIG. 5 Small cone, small hole, directly opposite FIG. 3—one and one-quarter inch diameter cone beveled to a depth of approximately three-eighths of an inch at circumference of one-half inch diameter, centered hole.
Figure 8:
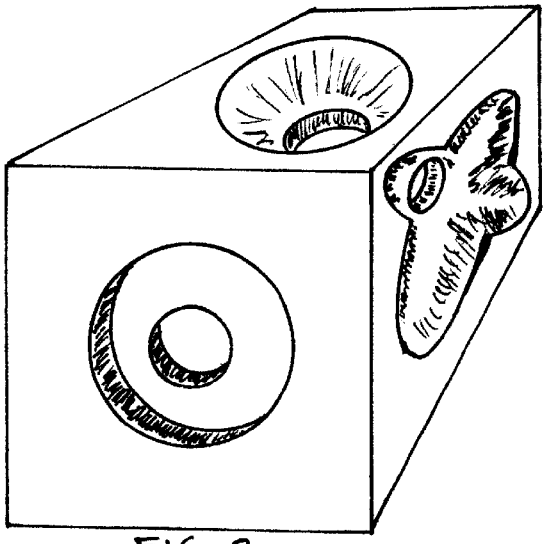
FIG. 8 Perspective view with FIG. 4 in front, FIG. 5 on top, and FIG. 6 on right.
Figure 4:
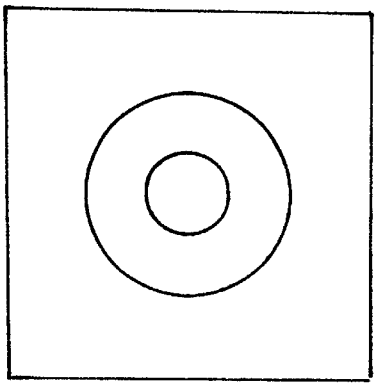
FIG. 4 Small cylinder, small hole, directly opposite FIG. 1—one and one-quarter inch diameter by one-quarter inch deep cylinder with one-half inch diameter, centered hole.
Figure 6:
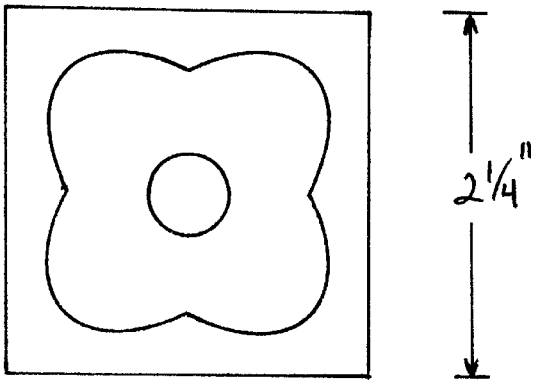
FIG. 6 Two small, crossed ovals in shape of four-pointed star, small hole—one and seven-eighths inch by three-quarter inch ovals beveled to a depth of approximately one-quarter of an inch at circumference of one-half inch diameter, centered hole.

The invention, in its simplest form, is a cube, measuring approximately two inches per side, with holes of various shapes and sizes in each side. The purpose is to support, without additional support aids, containers with irregular or odd shaped tops, which are also the dispensing points of the substance within the containers, so as to allow gravity to act upon the substance within the container and force it to settle at the dispensing point of the container.

The invention can be manufactured from virtually any hard material including, but not limited to, stone, wood, metal, and/or plastic, which would thereby preclude explaining, in detail, the process of making the invention since a specific process needed to manufacture the invention from wood, for example, can be quite different from that necessary to manufacture the invention from plastic.

What I claim as my invention is:

1. A device for holding a container in an inverted position comprising:

a hollow rectangular box comprising:

- a first outer face defining a large diameter counterbore and a smaller diameter throughbore;
- a second outer face defining an ovular cone;
- a third outer face defining a circular cone;
- a fourth outer face defining a throughbore and a counterbore of a diameter smaller than counterbore of the first face;
- a fifth outer face defining a circular cone of a diameter smaller than the circular cone of the third face;
- a sixth outer face defining two ovular cones rotated 90 degrees with respect to one another and having generally the same center.

2. The device of claim 1 wherein the throughbore of the first face is larger than the throughbore of the fourth face.

3. The device of claim 1 wherein the second face further defines a throughbore of a diameter smaller than the largest diameter of the ovular cone.

4. The device of claim 1 wherein the third face further defines a throughbore of a diameter smaller than the largest diameter of the circular cone.

5. A device for holding a container in an inverted position comprising:

a hollow rectangular box consisting essentially of:

- a first outer face defining a large diameter counterbore and a smaller diameter throughbore;
- a second outer face defining an ovular cone and a throughbore;
- a third outer face defining a circular cone and a throughbore;
- a fourth outer face defining a throughbore and a counterbore of a diameter smaller than counterbore of the first face;
- a fifth outer face defining a circular cone of a diameter smaller than the circular cone of the third face and a throughbore;

a sixth outer face defining two ovular cones rotated 90 degrees with respect to one another and having generally the same center and defining a throughbore.

6. A device for holding a container in an inverted position comprising:

a hollow rectangular box consisting of:

a first outer face defining a large diameter counterbore and a smaller diameter throughbore;

a second outer face defining an ovular cone and a throughbore;

a third outer face defining a circular cone and a throughbore;

a fourth outer face defining a throughbore and a counterbore of a diameter smaller than counterbore of the first face;

a fifth outer face defining a circular cone of a diameter smaller than the circular cone of the third face and a throughbore;

a sixth outer face defining two ovular cones rotated 90 degrees with respect to one another and having generally the same center and defining a throughbore.

* * * * *